US005902041A

United States Patent [19]

Parsons et al.

[11] Patent Number: 5,902,041

[45] Date of Patent: May 11, 1999

[54] DEFOAMING MIXING EDUCTOR

[76] Inventors: William G. Parsons, 23000 Apple Rd., Waterford, Wis. 53185; John M. Fritz, 811 West Puetz Rd., Oak Creek, Wis. 53154

[21] Appl. No.: 08/739,143

[22] Filed: Oct. 28, 1996

[51] Int. Cl.[6] ..... B01F 5/04; B01F 15/02

[52] U.S. Cl. ..... 366/163.2; 366/175.2

[58] Field of Search ..... 366/163.1, 163.2, 366/174.1, 175.2, 181.5; 239/427, 432, 498, 504

[56] References Cited

U.S. PATENT DOCUMENTS

| | | | |
|---|---|---|---|
| 2,669,946 | 2/1954 | Peyton | 366/181.5 |
| 2,809,073 | 10/1957 | Wahlert | 299/59 |
| 4,026,817 | 5/1977 | Ciuti et al. | 366/163.2 |
| 4,210,166 | 7/1980 | Munie | 366/163.2 |
| 4,344,752 | 8/1982 | Gallagher, Jr. | 366/163.2 |
| 4,594,005 | 6/1986 | Sakamoto et al. | 366/181.5 |
| 4,819,878 | 4/1989 | Bailey et al. | 366/181.5 |
| 4,860,933 | 8/1989 | Morane et al. | 222/402.13 |
| 5,158,235 | 10/1992 | Johnson | 239/570 |
| 5,472,145 | 12/1995 | Shannon et al. | 239/552 |
| 5,509,609 | 4/1996 | Kamler | 239/461 |
| 5,613,773 | 3/1997 | Scott et al. | 366/163.2 |

OTHER PUBLICATIONS

U.S. Patent Application 08/668,051, Greaney, filed Jan. 19, 1996.

U.S. Patent Application 08/634639, Boticki et al Apr. 18, 1996.

U.S. Patent Application 08/668051, Duchon et al, filed Jun. 14, 1996.

*Primary Examiner*—Tony G. Soohoo

[57] ABSTRACT

Disclosed is an eductor for mixing water with a foamable concentrated surfactant. A venturi aspirates the surfactant into a water stream. The diluted surfactant is then delivered into a bottle, pail, bucket, or other container, e.g. for use in custodial applications. A baffle chamber and spider baffle are provided downstream of the venturi in the eductor to reduce foaming. The baffle can be cross shaped, with a large central region.

14 Claims, 6 Drawing Sheets

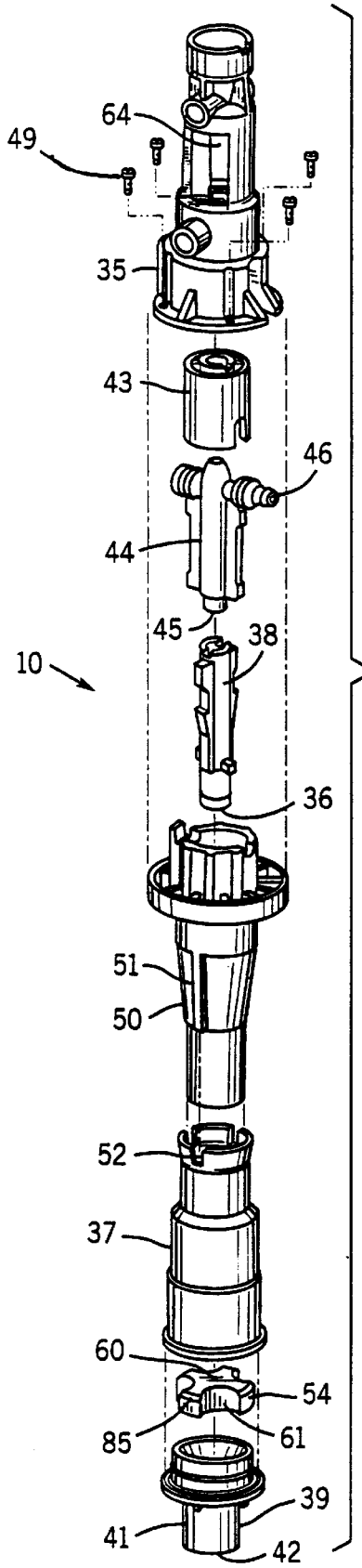
FIG. 3
FIG. 4
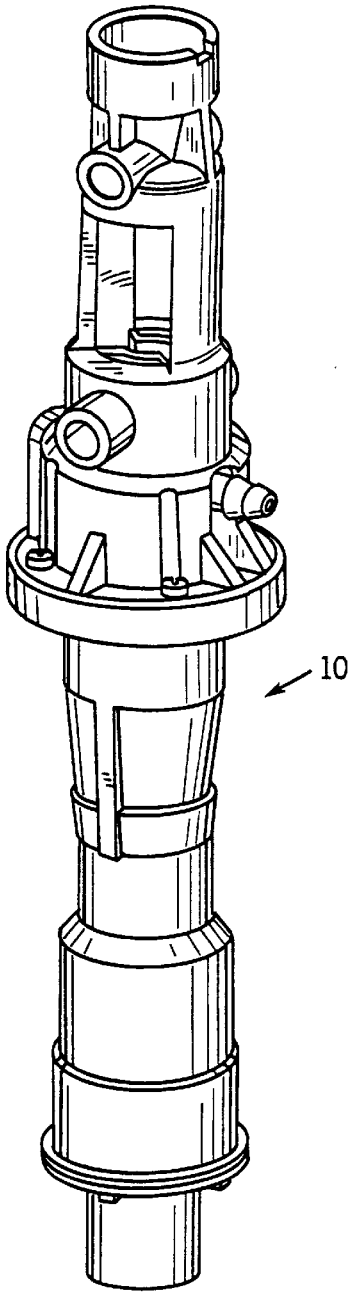

DEFOAMING MIXING EDUCTOR

TECHNICAL FIELD

This invention relates to equipment for mixing liquids and then filling containers with the mixed liquid. More particularly, it relates to using an eductor to dilute concentrated surfactants with water, and then filling a bottle or the like with the resulting diluted surfactant.

BACKGROUND ART

Venturi-type mixing devices, sometimes referred to as eductors, use aspiration to mix two liquids. An eductor directs a pressurized stream of a first liquid (usually water) through a venturi. A second inlet passage extends from a storage vessel (that holds a second liquid, e.g. a surfactant) to the downstream end of the venturi. A difference in pressure between the storage vessel and the eductor venturi outlet causes the second liquid to be drawn into the water stream.

Building custodial staffs use dispensing equipment to dilute surfactant concentrates and then dispense them. The concentrates are stored in vessels in the equipment, or are connected to the equipment by hoses. The equipment often includes eductor systems of the above type to dilute the concentrate to form cleaning solutions. The resulting solutions are then directed into a bottle, pail, bucket, or the like that will be used by the custodial staff to carry the cleaner.

One manufacturer of such dispensing equipment (sold under the trademark SOLUTIONS CENTER® and other trademarks) and liquid concentrates used therewith is S. C. Johnson & Son, Inc. of Racine, Wis. An eductor of the type used in SOLUTIONS CENTER® equipment is described in PCT Publication No. W091/16138 and U.S. Pat. No. 5,544,810 (Horvath et al.). Hand held dispensing/diluting equipment is also known. See e.g. U.S. Ser. No. 08/668,051. All applications and all publications referred to herein are incorporated herein by reference as if fully set forth. Concentrates used with such equipment have included a neutral cleaner, a "spray-and-wipe" cleaner/degreaser, a glass cleaner, and various other concentrates.

Such dispensing devices are not without some disadvantages when high foaming surfactants are used. In this regard, if a dilute solution of a cleaner is formed or delivered in a way that causes excessive foam, a container receiving the solution can overflow with foam even though only a small quantity of the solution has been added to it. This can cause undesirable delays during filling (e.g., while the user waits to let the foam subside). In some cases the delay can cause the user to "give up" in frustration and accept a partially filled container.

Complicating the design of improved dispensing systems is the need for the use of backflow protection. Plumbing codes require a means to protect the water supply from contamination due to backflow. This can be accomplished with various devices and combinations of them including mechanical vacuum breakers, check valves and air gap devices. Air gap devices are very attractive because they have no moving parts to malfunction, but they can add air to the water stream during operation. The addition of air to a water stream can exacerbate foaming.

It can therefore be seen that a need exists for an eductor which overcomes these shortcomings.

DISCLOSURE OF THE INVENTION

In one aspect the invention provides an eductor having two inlets leading to a venturi with a venturi outlet, a collection chamber with an upstream end and downstream end, and a final outlet, the eductor being for mixing a first liquid entering through a first of the inlets with a second liquid entering through a second of the inlets. The eductor has an entry housing that directs the first liquid from the first inlet through an air gap to the venturi downstream from the air gap. The venturi is capable of receiving the first liquid. The second inlet is positioned to permit the second fluid to be drawn into the venturi and then combined with the first liquid to form a mixture. The mixture then passes from the venturi outlet into the upstream end of the collection chamber.

The collection chamber is positioned between the venturi outlet and the final outlet. It is also connected to a baffle chamber on its downstream end.

A baffle (preferably a spider type baffle) is positioned in the baffle chamber. It has a central blocking region that inhibits direct, non-deflected flow of the mixture from the venturi outlet out of the final outlet, and at least one surface in contact with an internal wall of the baffle chamber.

The baffle preferably is a spider type baffle that has at least three legs, and most preferably four legs, in contact with the internal wall around the blocking region. A surface of the blocking region that faces the downstream end of the collection chamber can be downwardly tapered. There can also be a tube attached to the eductor at a point downstream of the spider for receiving the mixture and assisting in delivering it to a container.

In another preferred form the eductor can be generally tubular with the first inlet being on a central longitudinal axis of the eductor and the outlet being axially aligned with the first inlet. The second inlet can extend radially from the longitudinal axis.

In another aspect, the invention provides a method for mixing water and a surfactant to form a mixture and then filling a container with the mixture with reduced foaming. One causes water to flow through the first inlet of such an eductor, permits a surfactant to be drawn into the second inlet, and delivers the mixture into a container. The container is preferably a bottle, bucket, or a pail.

As is known in the art, high pressure water facilitates aspiration. It is also desirable to use it to minimize the time needed to fill a container. However, when high pressure water is used to dilute surfactants there can be serious foaming problems.

As will be appreciated from the description below, the baffle of the present invention de-energizes and deflects the high pressure water flow, yet does so without itself causing undue foaming or undesirable backflow. The de-energized water can then fill the container with less force, thereby reducing foam formation and improving filling capability.

The primary object of the invention is to provide a mixing eductor which significantly reduces foaming.

Another object of the invention is to provide a mixing eductor which is particularly well adapted for use with dispensing equipment that dispenses diluted surfactant into small-necked bottles.

Another object of the invention is to provide an eductor of the type having an air gap to provide backflow protection.

Yet another object is to provide an eductor of the above type which is inexpensive to produce and maintain.

Still another object is to provide methods for filling containers with foamable diluted surfactants, using eductors of the present invention.

Other objects, features and advantages of the present invention will become apparent after examination of the specification and claims which follow.

BRIEF DESCRIPTION OF THE DRAWINGS

FIG. 3 is an enlarged, exploded perspective view of an eductor of the present invention;

FIG. 4 is an assembled perspective view of the FIG. 3 eductor;

DETAILED DESCRIPTION OF THE INVENTION

Figure 1:
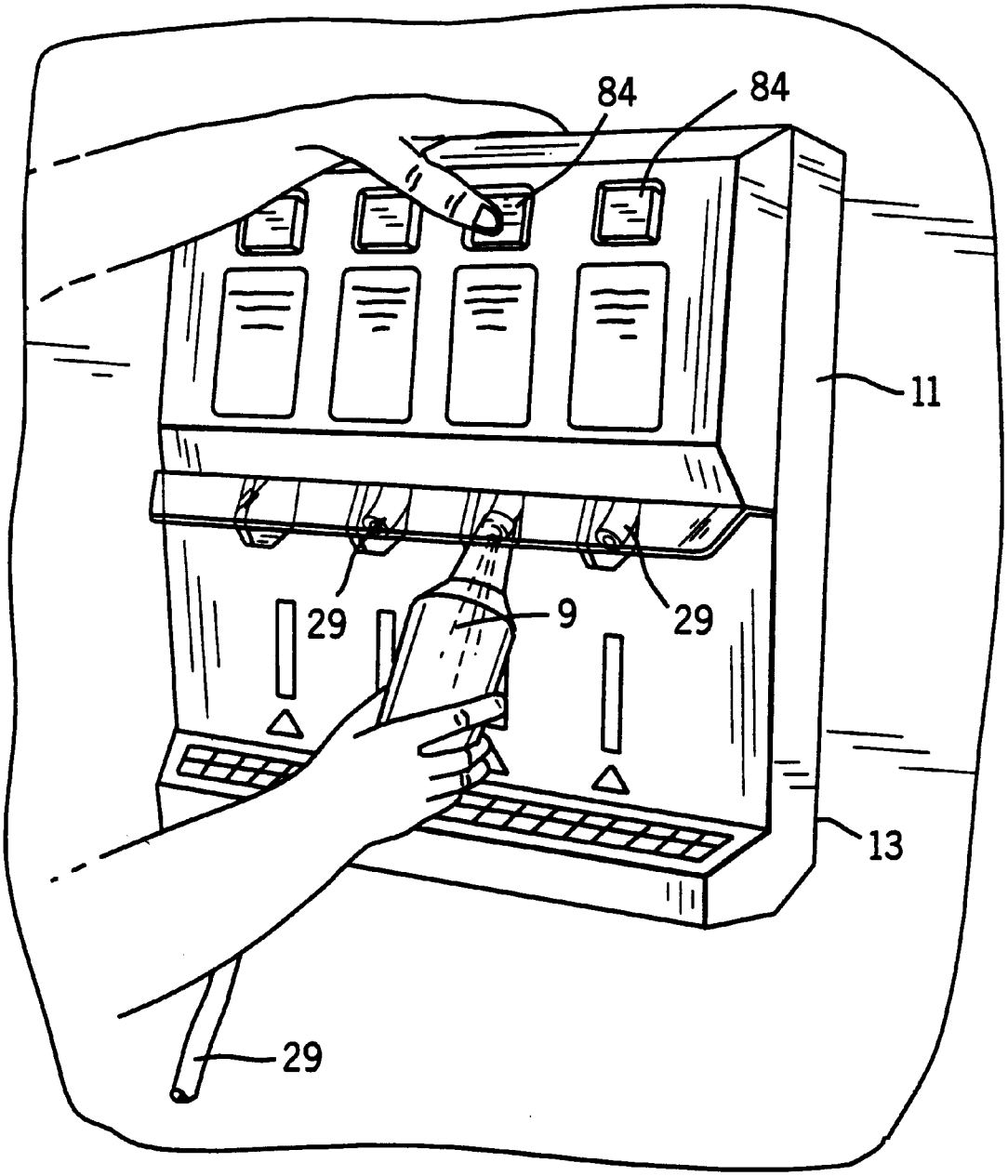
FIG. 1 is a schematic perspective view of a custodian using dispensing equipment.
Figure 2:
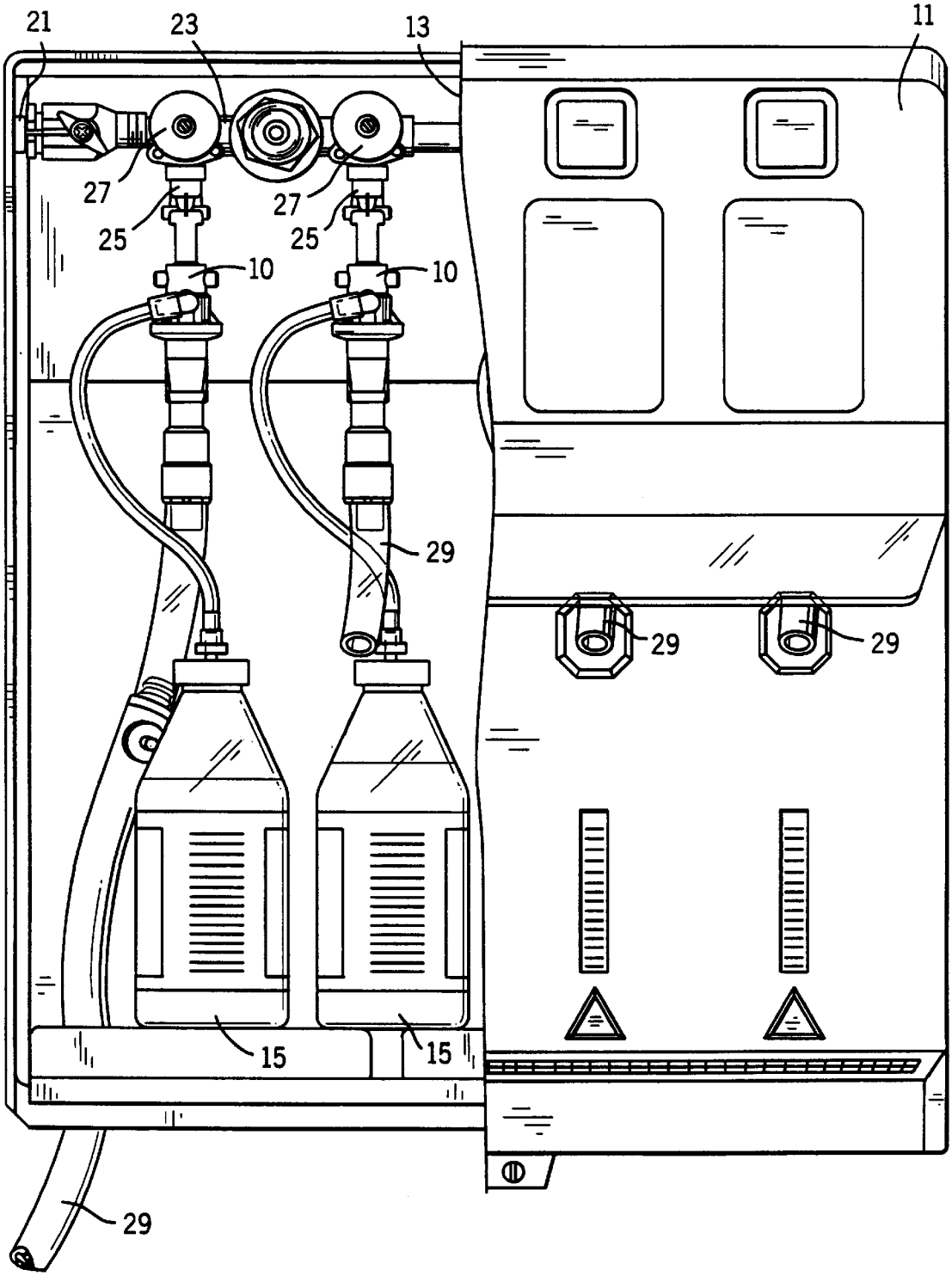
FIG. 2 is a frontal view of the FIG. 1 equipment, albeit with a front panel partially broken away.
Figure 5:
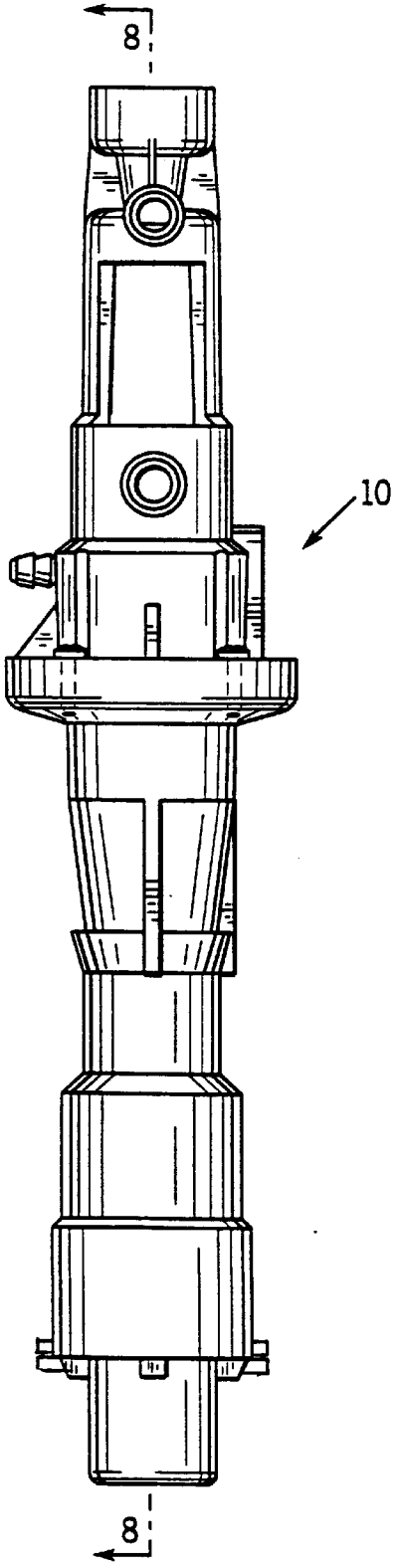
FIG. 5 is a rear elevation view of the FIG. 3 eductor.
Figure 6:
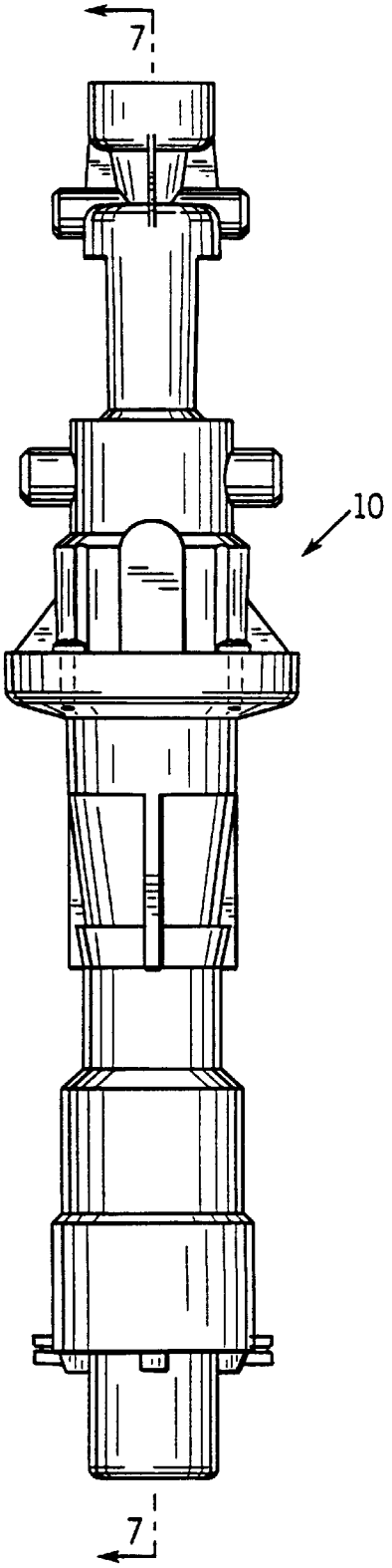
FIG. 6 is a left side elevational view of the FIG. 3 eductor.

FIGS. 1 and 2 show dispensing equipment 11 having an outer housing 13 and containers 15 in the housing. Alternatively, the containers could be positioned outside the housing 13 but connected by longer hoses. Each container 15 is filled with a liquid surfactant concentrate (not shown). There may be occasions where it is desirable to have more than one container 15 filled with the same liquid surfactant concentrate. However, preferably each container has a different one.

A wide variety of liquid surfactant concentrates can be placed in these containers (e.g. anionic, cationic, non-ionic and zwitterionic surfactants), with or without other cleaning additives. However, the invention is particularly useful with high foaming surfactants. One example is "Glance®" from S. C. Johnson (a mixture of sodium lauryl sulfate, sodium xylene sulfonate, tetrasodium salt of EDTA, ammonium hydroxide, water, and 2-butoxyethanol).

An inlet line 21 of the dispenser 11 is connected to a source of pressurized tap water that feeds a header 23. Branch pipes 25 from the header include valves 27. When a valve 27 is actuated (e.g., in response to a button 84 being pushed on the front of the machine), pressurized water flows through the eductors 10, which create vacuum, thereby drawing concentrated surfactant into the water stream and forming a diluted cleaning solution that exits through hoses 29.

As best seen in FIG. 3, each eductor 10 has a generally tubular body with an entry housing section 35 and an outlet section 37, the latter having a coupling 39 attached thereto. Coupling 39 has a necked-down portion 41 terminating in final outlet port 42. A flexible hose 29 is friction fitted on the neck.

Figure 7:
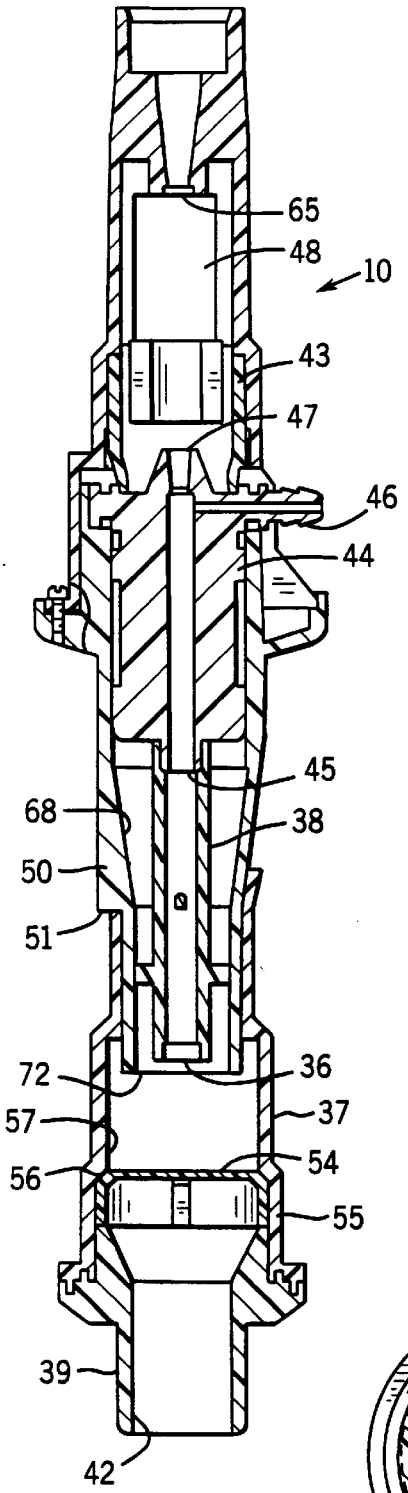
FIG. 7 is a sectional view of the eductor taken along plane 7—7 of FIG. 6.

The venturi is in two parts, main insert 44 and extension 38. Insert 44 has an outlet 45 and is connected by a tube 46 to a surfactant concentrate supply. A venturi inlet 47 (see FIG. 7) receives water from main passage 48 (coming from nozzle 65 across air gap 64) and outlet 45 delivers a mixed stream. Extension conduit 38 fits on outlet 45. It has its own extension exit 36 (the "venturi outlet").

There is also a brace 43, an intermediate guide tube 50, and screws 49 retain the brace 43, insert 44, and extension 38 between the entry 35 and guide tube 50. Members 37 and 50 could alternatively be formed as one piece. However, here they are interfitted by jamming ribs 51 into slots 52, followed by sonic welding or other secure attachment.

Figure 9:
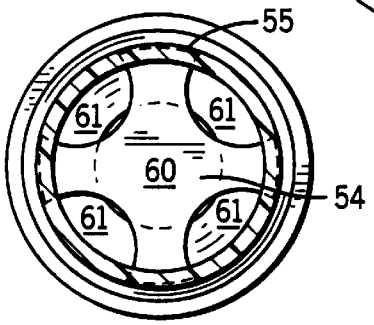
FIG. 9 is a sectional elevation view of the eductor taken along the viewing plane 9—9 of FIG. 6.

In accordance with the present invention, there is also "spider" type (e.g. preferably 3–6 legs, and most preferably, 4 legs) baffle 54. In top view (FIG. 9) the preferred form can be seen to be somewhat cross shaped. The legs of the cross jam fit against the walls 55 of an inner counterbore 56 (see FIG. 7) which is slightly greater in diameter than collection bore 57. The spider baffle 54 is inserted and held in place by insertion of coupling 39 against the undersurface of the spider baffle 54. Coupling 39 can be held in place by various conventional means, including sonic welding.

The spider baffle 54 is shown as hollow on its underside. However, it could instead be cut from a solid slab. In the most preferred form the spider baffle has four legs. However, it could have as few as three or as many as six, or the side passages could be 3–6 holes. However, it has been discovered that as the number of holes/passages increases to seven or more (e.g. a wire screen), the anti-foaming characteristics of the device can be seriously adversely affected.

Figure 8:
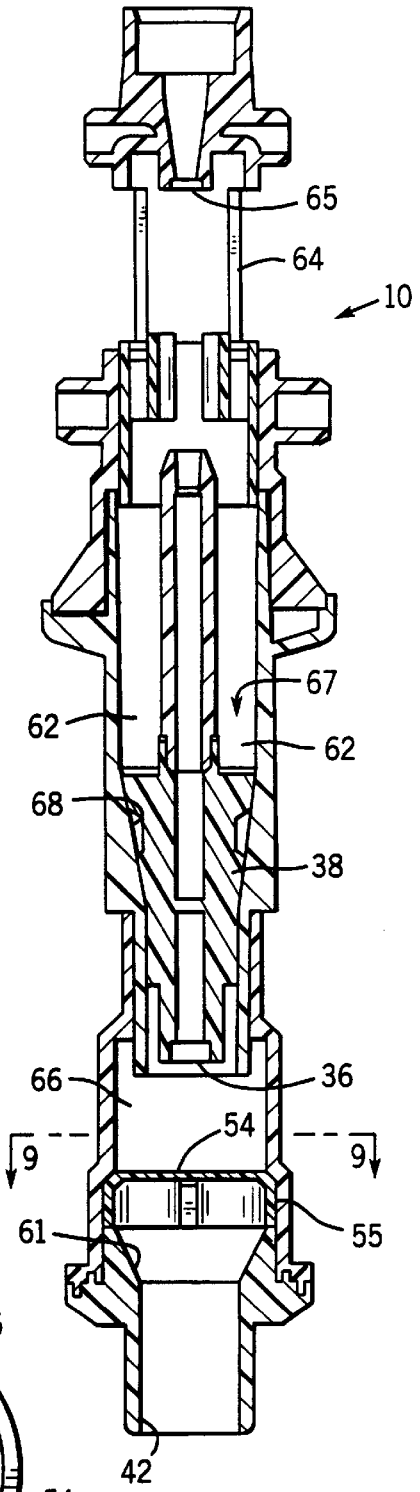
FIG. 8 is a sectional view of the eductor taken along plane 8—8 of FIG. 5.

In a preferred form, a top blocking surface 60 of the spider baffle has an area greater than the cross-sectional area of the extension exit 36. Thus, the highest velocity flow is directed in a tight downward vertical manner directly onto the blocking surface 60. As shown in FIG. 8, pathways 62 permit gathering streams to leak around the insert 44 and extension 38 to collection chamber 66 to assist in directing flow onto surface 60. Essentially, no high velocity water is permitted to flow directly down into the side pathways 61 without first contacting the spider baffle (or at least being deflected). If desired, the edges of the intersection between the top surface 60 of the spider baffle and its sides can be sloped to create smoother flow at the baffle edge 85 (see e.g. FIG. 3).

Entry housing 35 has an air gap 64 so that water entering through entry housing 35 and passing through nozzle 65 must first flow past the air gap. See especially FIG. 8. Most of the water is then directed through the venturi. However, as noted above, at least some of the water passes down through pathways 62 along the sloped sides 68 in the guide tube 50.

Notwithstanding the baffling caused by spider 54, the back pressure inside the eductor, even at a flow rate such as 2.5 gallons (9.48 liters) per minute (the preferred flow rate), is sufficiently low so that there is no significant back flow out the air gap. Also, no significant reverse foaming through the air gap was noted during tests run to date.

Figure 10:
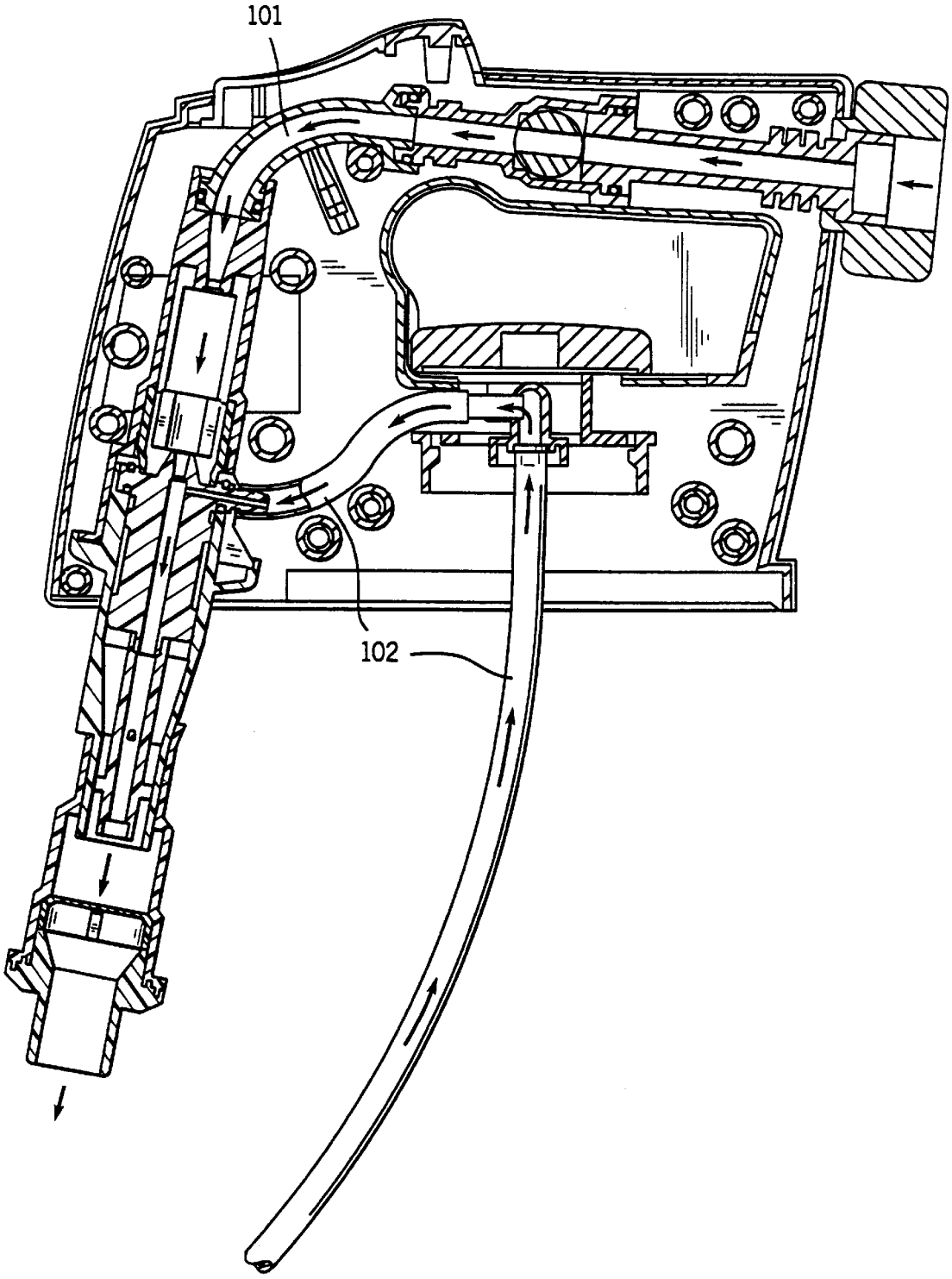
FIG. 10 is a simplified sectional view through a hand held type dispenser of the type described in U.S. Ser. No. 08/668,051 showing how the eductor of the present invention can also be used with that type of equipment.

Moreover, even though pressurized water is directly projected onto the spider, in experiments run to date using a bottle like bottle 9 shown in FIG. 1 with FIG. 10 type equipment the spider markedly reduced foam. For example, some test bottles received a mix of tap water and Glance® cleaning solution. We were able to fill them only to about 40 percent of their volume before the foam took up the remaining space when the spider wasn't used. When the spider was used, we could fill empty bottles to as much as 80 percent of their total volume before the foam either overflowed or required us to wait to continue filling.

One might have expected that the agitation of the water against the spider baffle region 60 would have caused more foaming. Instead, it reduced foaming.

It should therefore be appreciated that the invention provides a spider baffle in the flow path after the water and surfactant concentrate have mixed. The mixture flows axially down after passing the spider baffle 54.

As noted above, the eductor 10 has been used to help fill a bottle with a foamable diluted surfactant. To do this we caused water to run into the eductor and aspirate surfactant concentrate into the water. The mixed fluid then flowed onto the spider 54, passed by side pathways 61, out the final outlet port 42 and hose 29, and then filled a bottle.

In the preferred form, the distance between the bottom edge of the extension exit 36 and the baffle blocking surface 60 is such so as to prevent water from backing up from the collection chamber into passageway 62 and on up, e.g. typically at least 0.6" (1.52 cm) for a flow of 9.48 liters per minute, with an extension exit 36 diameter of 0.268" (0.67 cm), and a collection chamber diameter of 0.98" (2.51 cm). This represents a volume (between surface 60 and exit 36) of 0.488 inches$^3$ (7.86 cm$^3$) where the aforesaid distance was 0.639 inches (1.63 cm).

Also, the preferred thickness of the spider baffle is about a half an inch (1.27 cm), albeit other thicknesses also work. The eductor can be made from plastic components suitable for use in a water/surfactant environment (e.g. Celcon®, a plastic sold by Hoechst Celanese Corporation). However, other materials can be used for forming the eductor.

Another intended use of the eductor of the present invention is as an eductor for a hand held dispensing system like those described/depicted in U.S. Ser. No. 08/668,051 (hereby incorporated by reference to show such a system), a simplified view of which is shown FIG. 10. As will be evident from FIG. 10, the eductor is the same as for the FIG. 1 equipment. However, it now receives water via line 101 and surfactant from line 102.

What has been described above are only the preferred embodiments of the invention. Other embodiments are also within the intended scope of the claim. For example, the eductor could be used to mix a carbonated water supply with a soft drink concentrate (e.g. for use in filling soda bottles).

Industrial Applicability

The present invention is useful in permitting bottles and other containers to be rapidly filled with a foamable liquid.

We claim:

1. In an eductor having two inlets leading to a venturi member with a venturi outlet, a collection chamber with an upstream end and downstream end, and a final outlet, the eductor for mixing a first liquid entering through a first of the inlets with a second liquid entering through a second of the inlets, wherein the eductor has an entry housing that directs the first liquid from the first inlet through to the venturi member downstream thereof, the venturi member being capable of receiving the first liquid, and wherein the second inlet is positioned to permit the second fluid to be drawn into the venturi member and mixed with the first liquid to form a mixture that passes from the venturi outlet into the upstream end of the collection chamber, the collection chamber being positioned between the venturi member outlet and the final outlet, the improvement comprising:

the collection chamber has connected thereto a baffle chamber on its downstream end;

there is a baffle positioned in the baffle chamber which has a central blocking region that inhibits direct, non-deflected flow of the mixture from the venturi outlet out of the final outlet, the baffle also having at least one surface in contact with an internal wall of the baffle chamber; and an air gap is positioned between the first inlet and the venturi member.

2. The eductor of claim 1, wherein the baffle is a spider baffle that has at least three legs in contact with the internal wall of the baffle chamber around the blocking region.

3. The eductor of claim 2, wherein a surface of the central blocking region facing upstream is downwardly tapered in the direction of the downstream end.

4. The eductor of claim 2 wherein the baffle has no more than six legs.

5. The eductor of claim 4 wherein the baffle has four legs.

6. The eductor of claim 1, wherein there is a tube attached to the final outlet for receiving the mixture and for delivering it to a container.

7. The eductor of claim 1, wherein the collection chamber is positioned inside an intermediate housing and between the baffle chamber and the air gap.

8. The eductor of claim 1, wherein the first inlet is on a central longitudinal axis of the eductor and the outlet is axially aligned with the first inlet.

9. The eductor of claim 1, wherein a downstream edge of the venturi member is positioned at least one-half inch (1.27 cm) from an upstream facing surface of the baffle.

10. The eductor of claim 9, wherein said edge is at least 0.6 inches (1.52 cm) from said facing surface.

11. The eductor of claim 1, wherein there is at least 7 cm$^3$ of volume in the eductor between a downstream edge of the venturi member and an upstream facing surface of the baffle.

12. A method for mixing water and a surfactant to form a mixture and then filling a container with the mixture with reduced foaming, the method comprising the steps of:

causing water to flow through the first inlet of the claim 1 eductor;

permitting the surfactant to be drawn into the second inlet of the eductor; and delivering a mixture from the eductor into the container.

13. The method of claim 12, wherein the container is selected from the group consisting of a bottle, pail, or bucket.

14. In an eductor having two inlets leading to a venturi member with a venturi outlet, a collection chamber with an upstream end and downstream end, and a final outlet, the eductor for mixing a first liquid entering through a first of the inlets with a second liquid entering through a second of the inlets, wherein the eductor has an entry housing that directs the first liquid from the first inlet through an air gap to the venturi downstream from the air gap, the venturi member being capable of receiving the first liquid, and wherein the second inlet is positioned to permit the second fluid to be drawn into the venturi member and mixed with the first liquid to form a mixture that passes from the venturi outlet into the upstream end of the collection chamber, the collection chamber being positioned between the venturi outlet and the final outlet, the improvement comprising:

the collection chamber is positioned inside an intermediate housing and between the baffle chamber and the air gap and has connected thereto a baffle chamber on its downstream end; and there is a baffle positioned in the baffle chamber which has a central blocking region that inhibits direct, non-deflected flow of the mixture from the venturi outlet out of the final outlet, the baffle also having at least one surface in contact with an internal wall of the baffle chamber;

wherein the venturi member is positioned in the eductor in a way so as to leave a secondary flow path for a portion of the first liquid outside of the venturi member.

* * * * *